US006922853B2

(12) United States Patent
Mantell

(10) Patent No.: US 6,922,853 B2
(45) Date of Patent: Aug. 2, 2005

(54) TOILET SEAT ADJUSTMENT

(76) Inventor: Robert S. Mantell, 15 Acadia Park #2, Somerville, MA (US) 02143

( * ) Notice: Subject to any disclaimer, the term of this patent is extended or adjusted under 35 U.S.C. 154(b) by 0 days.

(21) Appl. No.: 10/620,182

(22) Filed: Jul. 15, 2003

(65) Prior Publication Data

US 2005/0010998 A1 Jan. 20, 2005

(51) Int. Cl.[7] ..... A47K 13/10
(52) U.S. Cl. ..... 4/246.1
(58) Field of Search ..... 4/246.1–246.5

(56) References Cited

U.S. PATENT DOCUMENTS 2,758,315 A * 8/1956 Hylton ..... 4/246.1
4,951,324 A * 8/1990 Lirette ..... 4/246.1
5,806,106 A * 9/1998 Carter et al. ..... 4/246.1
6,305,031 B1 * 10/2001 White ..... 2/455

* cited by examiner

*Primary Examiner*—Charles E. Phillips

(57) ABSTRACT

In general, in one aspect, the disclosure describes a device to enable a user to move a toilet seat from an up position to a down position. The device includes a connection mechanism to connect the device to the toilet seat, a handle, and a pivoting assembly, coupled to the connection mechanism and the handle, to permit the handle to pivot relative to the toilet seat.

15 Claims, 5 Drawing Sheets

TOILET SEAT ADJUSTMENT

BACKGROUND

Usually, in order to pick up a toilet seat, a person will stoop almost in half, hook a finger under a sometimes unfamiliar and suspicious seat, and slowly lift the seat. While in this bent position, the person may move forward, in an effort to place the seat into its resting position against the back toilet tank. Likewise, when a toilet seat goes down, it must be guided carefully the whole way, lest it bang down. Thus, a person's body slowly folds with the seat until the seat finally rests on the toilet rim.

DETAILED DESCRIPTION

Disclosed herein is a device that allows people to adjust toilet seats between the up and down seat positions with minimal effort. The device enables a person to position the toilet seat with dignity, comfort and with a great sense of cleanliness. Additionally, by eliminating or reducing bending and reaching, the device can assist those with limited range of movement and those who experience pain from such motions. Further, through its ease of use, the device can facilitate an end to conflicts over seat position.

Figure 1:
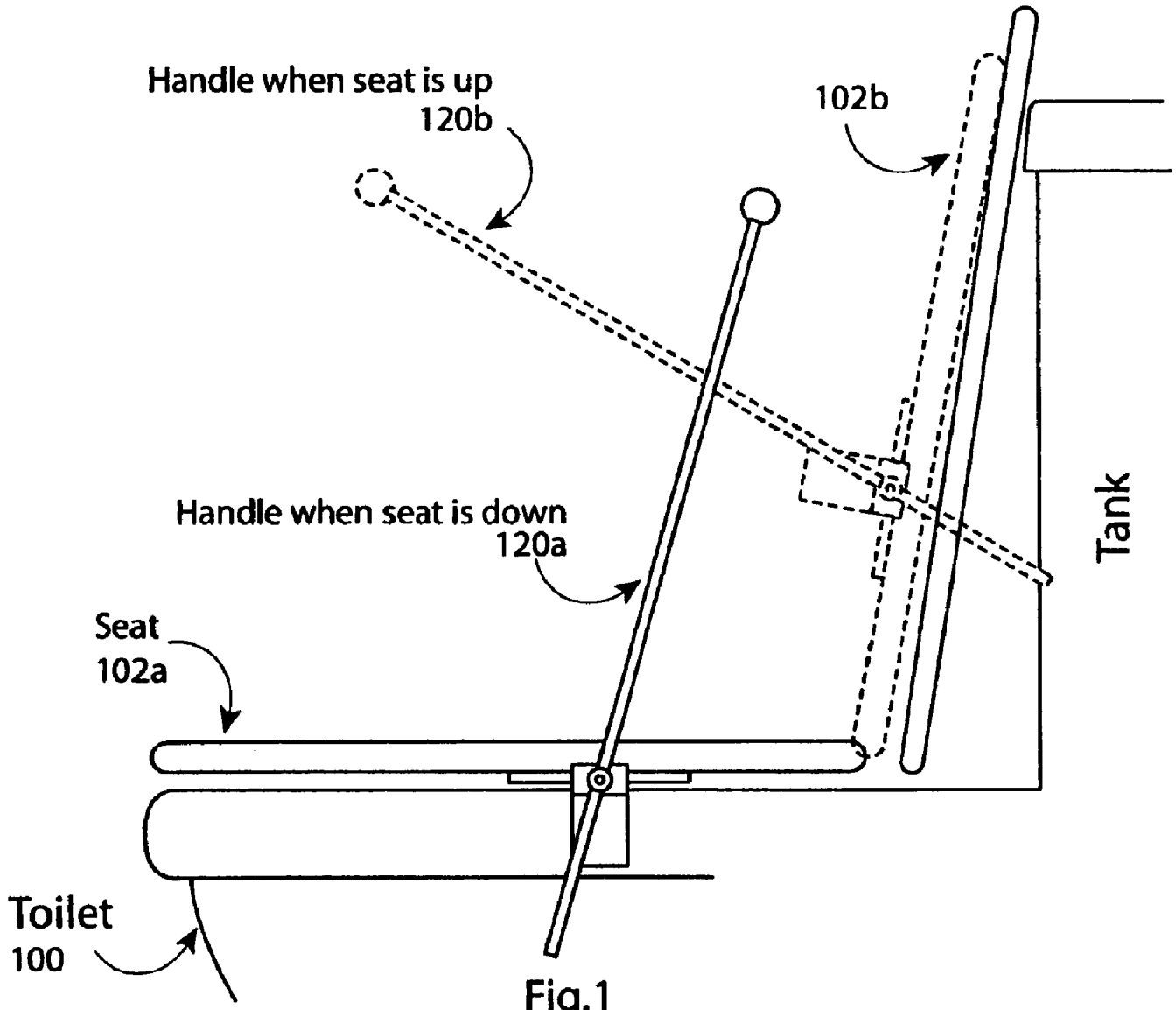
FIG. 1 is a diagram illustrating adjustment of a toilet seat.

FIG. 1 illustrates operation of the device after being attached to a toilet seat 102*a*. As shown, the device includes a handle 120 and an assembly that enables the handle 120 to pivot relative to the seat 102 (i.e., the angle formed by the handle 120 and the seat 102 varies). Manipulation of the handle (from 120*a* to 120*b*) repositions the seat from the down position 120*a* to the up position 102*b*. When the toilet seat is down 102*a*, the handle 120*a* extends upward to the hand for ready lifting. When the toilet seat is up 102*b*, the handle 120*b* extends out, almost parallel to the floor, in excellent position for easy gripping. The extent that the handle 120 extends from the seat 102 may be adjusted and permits tailoring of the device to a person's individual needs. The device permits the seat 102 to be guided up and down with a simple wrist motion while the person remains in an upright position.

As an example of device operation, to move the seat from the down 102*a* to up 102*b* position, a person can slightly lift a knob or other grip atop the handle 120*a*. This lifting causes the handle 120*a* to being pivoting relative to the seat 102. This initial momentum and change in the handle 120/seat 102 angle enables a minimal handle push of the handle to rest the seat 102 against the toilet tank.

To move the seat from the up 102*b* to down 102*a* position, a person can gently tug the handle 120*b* grip. This causes the seat 102 to begin to fall. This fall, however, is moderated by operation of the handle. That is, the seat 102 can only fall at the rate permitted by a person's manipulation of the handle 120.

In both cases, a person can quickly and intuitively adjust the seat 102 with a minimum of effort. In practice, the reduction in the effort of moving the seat 102 and the elimination of the distastefulness of touching the seat 102 can result in greater vigilance in returning the seat 102 to an agreed upon position.

Figure 2:
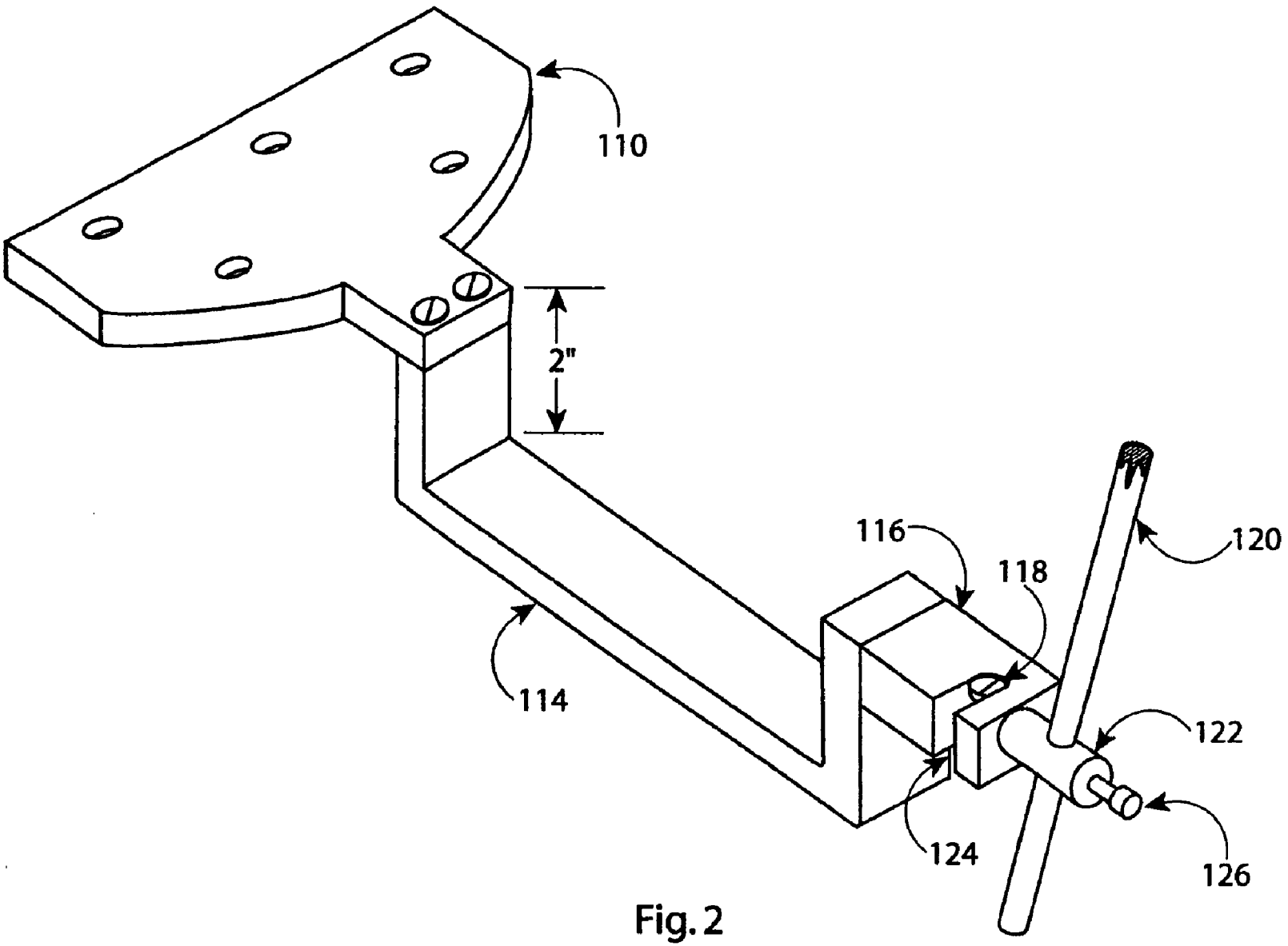
FIG. 2 is a perspective diagram of a device to adjust the position of a toilet seat.

FIG. 2 depicts a perspective view of the device in greater detail. As shown, the device includes a connecting plate 110 or other connection mechanism (e.g., adhesives or a clip) to attach the device to a toilet set. The connecting plate 110 shown includes pre-drilled holes sized to permit screws to attach the plate 110 to the underside of a toilet seat 102.

Attached to the connecting plate 110 may be an extension 114 that leads away from the seat 102 and separates the handle 120 from the seat by a distance between one and twelve inches (e.g., between 7 and 8 inches). The extension 114 reduces a sense of claustrophobia, provides a seated user with a wide range of motion, and prevents the device from touching and annoying the user.

As shown, the extension 114 may be configured to dip down almost immediately after its connection with the connecting plate 110. The dip in this case is approximately 2 inches, but could vary. This dip can help prevent contact between the extension 114 and the thigh of the user on the seat. The extension 114 may angle back up again so that the distant portion of the device is approximately at the same height or higher than connecting plate 110.

At the end of the extension 114 is an assembly 116 that permits the handle 120 to pivot relative to the seat 102. The assembly may use a variety of pivoting mechanisms (e.g., ball and socket joint). In the implementation shown, a round hole is bored into the assembly 116 and, potentially, the end of the extension 114. A rod 122 is inserted into the hole such that the rod 122 can freely rotate.

To restrict rotation of the rod 122, a groove 124 may be cut into the assembly 116. In some implementations, the handle will be inserted into the rod 122 in the space provided by the groove 124. In the implementation shown, a retaining pin 118 may be connected to the portion of the rod 122 located within the groove 124. The pin 118 has a length that exceeds the diameter of the rod 122 and is inserted through the center of the rod at an angle normal to the rod 122 surface. While the groove 124 walls do not directly restrict rotation of the rod 122, rotating the rod 122 far enough in either direction causes the pin 118 to be restrained from further rotation, by the groove 124 walls. The groove 124 illustrated permits approximately 80 degrees of rotation.

As shown, a handle rod 120 may be attached to rotating rod 122. The handle rod 120 illustrated is approximately 12 inches, but different lengths are possible. Where the handle rod 120 attaches to the rotating rod 122, a mechanism (e.g., a screw) permits adjustment of the handle rod 120 upward or downward, in relation to the end of the rod 122. This feature permits the user to tailor the height of the handle 120 for maximum convenience (e.g., a taller person may prefer a longer distance between a knob at the end of the handle rod 120 and the rotating rod 122). At the end of the handle rod 120 is a knob or other grip which is easy to hold and manipulate with one's hand. For example, the grip may be constructed from a dowel to form a "T" at the top of the handle. For instance, a hole may be bored through the top of the handle rod 120 to hold the dowel while permitting free rotation of the dowel.

When the seat is down 102, the handle rod 120 may be rotated to the extent allowed by the groove 124, such that the handle rod 120 is standing up, yet leaning slightly back toward the toilet tank. Thus, the resting position for the handle rod 120 is almost vertical. The user picks up the seat 102 by grabbing the handle (e.g., by a handle 120 grip) lifting slightly with the arm, and then, with a wrist motion, using the handle rod 120 to push the seat 102 away as it rises. With the seat 102 in its lifted position, the handle rod

120 is at its resting point. The handle 120 extends toward the user at an approximately 30 degrees angle to the floor. The handle is approximately 19 inches higher than the toilet rim, and approximately 8 inches to the side. The seat can now easily be lowered.

Figure 3:
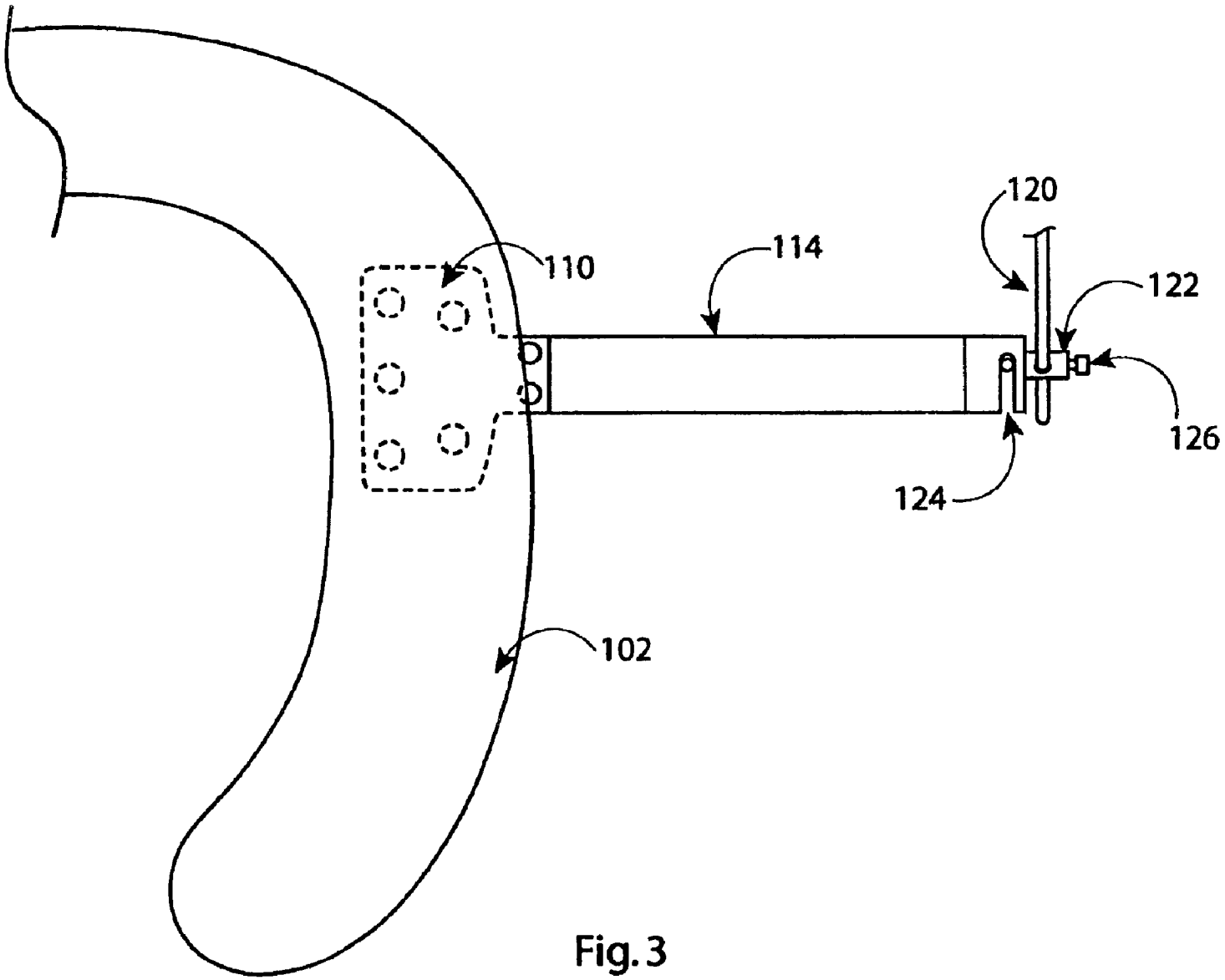
FIGS. 3–5 are schematic views of a device to adjust the position of a toilet seat.
Figure 4:
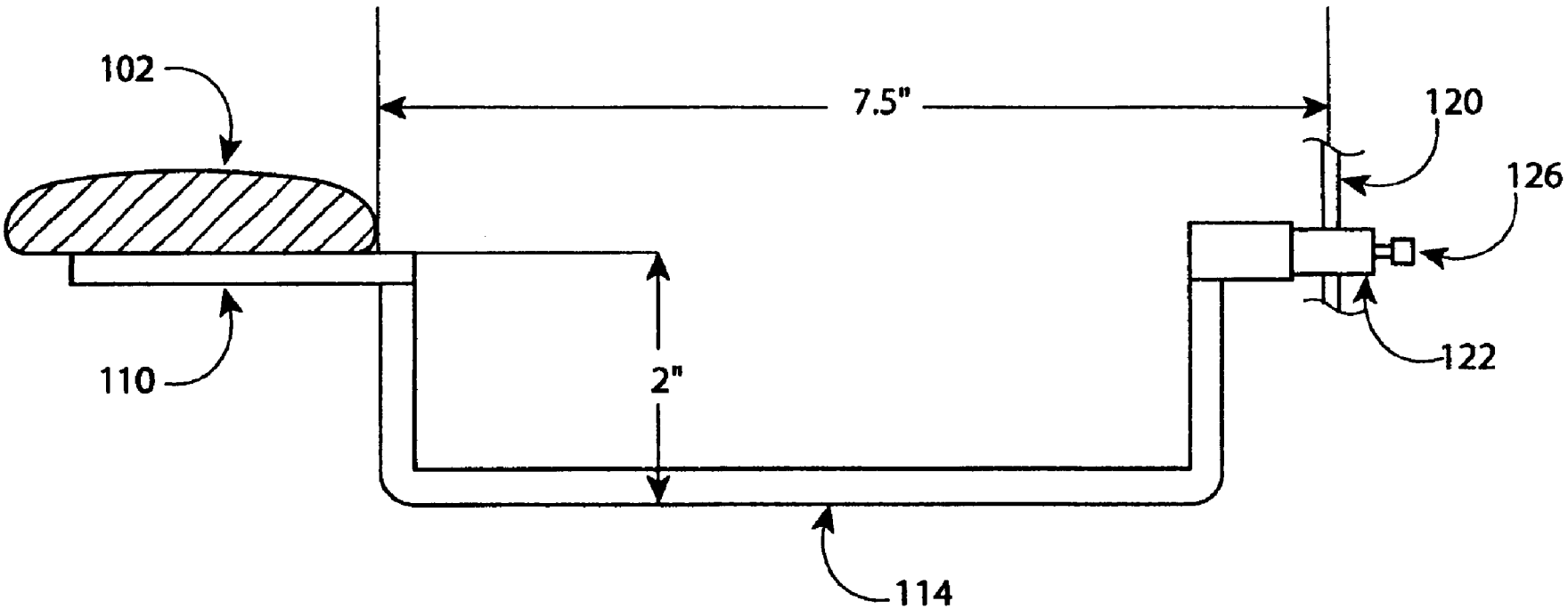
Figure 5:
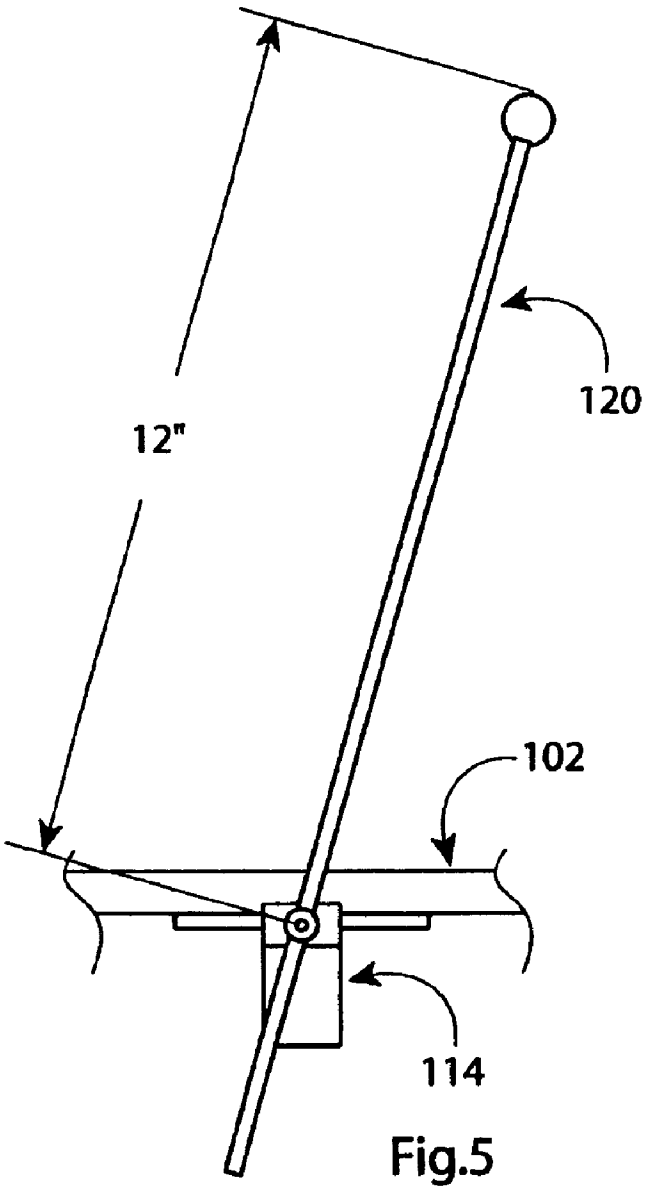

FIGS. 3–5 provide different schematic views of the device. In particular, FIG. 3 depicts a view from above, and shows the installation of the device on the underside of a toilet seat 102. As shown, the connecting plate 110 is attached to the seat 102 at the approximate mid-point between the front and back of the seat 102, so that it extends approximately perpendicularly away from the toilet seat, at the seat's 102 side.

While described above with reference to a particular implementation, a wide variety of other implementations may use techniques described above. For example, instead of being attached to a toilet seat, a seat 102 integrating the device may be produced. Additionally, a wide variety of other implementations may be used to enable the handle to pivot relative to the seat.

Other embodiments are within the scope of the following claims.

What is claimed is:

1. A device to enable a user to move a toilet seat from an up position to a down position, the device comprising:

a connection mechanism to connect the device to the toilet seat;

a handle; and a pivoting assembly coupled to the connection mechanism and the handle, the pivoting assembly to permit the handle to pivot relative to the toilet seat and restrain the annular range of motion of the handle relative to the toilet seat such that the pivoting assembly supports the handle upward when the toilet seat is in the down position and supports the handle angled outward when the toilet seat is in the up position, wherein the pivoting assembly comprises a mechanism to permit the length of the handle extending from the pivoting assembly to be adjusted.

2. The device of claim 1, further comprising an extension that separates the handle from the seat.

3. The device of claim 2, wherein the extension dips down at one end and angles upward at the other.

4. The device of claim 2, wherein the extension is between 1 and 12 inches in length.

5. The device of claim 4, wherein the extension is between 7 and 8 inches in length.

6. The device of claim 4, wherein the pivoting assembly comprises a rod connected to the handle that rotates within a hole.

7. The device of claim 1, wherein the angular range of motion is less than 90 degrees.

8. The device of claim 1, wherein the angular range of motion is 80 degrees.

9. The device of claim 1, wherein at least a portion of the handle can axially rotate.

10. A toilet seat, comprising:

a seat;

an extension that radially extends from the seat;

a handle; and a pivoting assembly coupled to the extension and the handle, the pivoting assembly to permit the handle to pivot relative to the toilet seat and restrain the angular range of motion of the handle relative to the toilet seat such that the pivoting assembly supports the handle upward when the toilet seat is in the down position and supports the handle angled outward when the toilet seat is in the up position, wherein the pivoting assembly comprises a rod connected to the handle that rotates within a hole.

11. The seat of claim 10, wherein the extension dips down at one end and angles upward at the other.

12. The seat of claim 10, wherein the extension is between 1 and 12 inches in length.

13. The seat of claim 12, wherein the extension is between 7 and 8 inches in length.

14. The toilet seat of claim 10, wherein the pivoting assembly further comprises a mechanism to permit the length of the handle extending from the pivoting assembly to be adjusted.

15. The toilet seat of claim 10 wherein the rod includes a pin, extending normally from the rod surface; and wherein the portion of the rod including the pin is within a groove that restricts the angular range of motion of the rod by preventing movement of the pin beyond a wall of the groove.

* * * * *